US005852668A

United States Patent [19]

Ishige et al.

[11] Patent Number: 5,852,668

[45] Date of Patent: Dec. 22, 1998

[54] HEARING AID FOR CONTROLLING HEARING SENSE COMPENSATION WITH SUITABLE PARAMETERS INTERNALLY TAILORED

[75] Inventors: Ryuuichi Ishige; Reishi Kondo, both of Tokyo, Japan

[73] Assignee: NEC Corporation, Tokyo, Japan

[21] Appl. No.: 773,952

[22] Filed: Dec. 26, 1996

[30] Foreign Application Priority Data

Dec. 27, 1995 [JP] Japan ..... 7-340826

[51] Int. Cl.[6] ..... H04R 25/00

[52] U.S. Cl. ..... 381/312; 381/60

[58] Field of Search ..... 381/231, 60, 68.2, 381/68.4, 68, 312, 314, 320, 321, 323; 73/585; 128/746

[56] References Cited

U.S. PATENT DOCUMENTS 4,425,481 1/1984 Mansgold et al. ..... 381/68
4,901,353 2/1990 Widin ..... 381/68.2

FOREIGN PATENT DOCUMENTS 3-284000 12/1991 Japan .
4-242400 8/1992 Japan .

*Primary Examiner*—Huyen Le
*Attorney, Agent, or Firm*—Foley & Lardner

[57] ABSTRACT

A hearing aid stores a plurality of sets of hearing aid parameters in built-in memories, and tailors suitable hearing aid parameters through an interpolation between the sets of hearing aid parameters so as to cope with new working conditions, thereby allowing a user to adjust the hearing aid to his hearing sense.

12 Claims, 1 Drawing Sheet

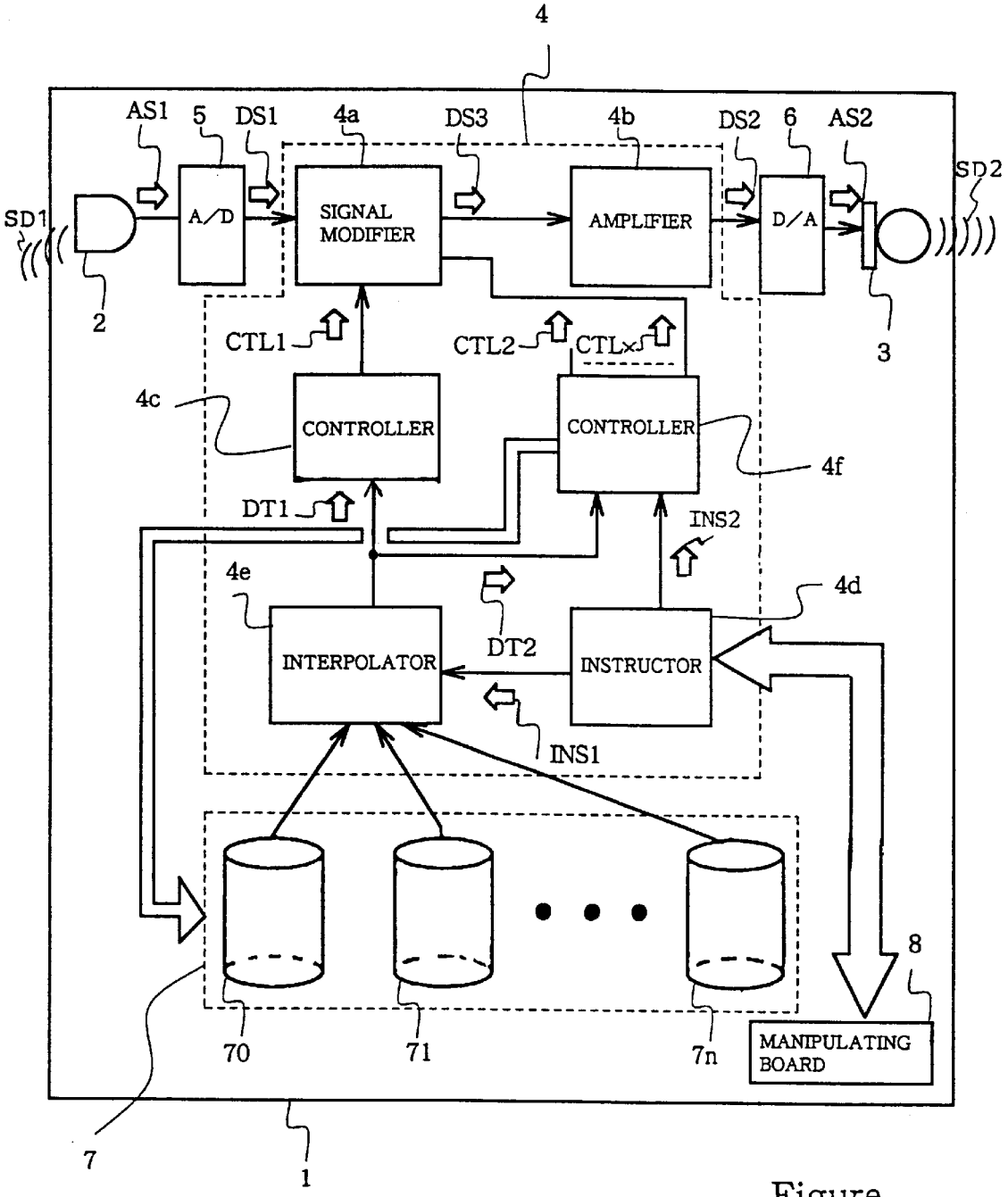
Figure

HEARING AID FOR CONTROLLING HEARING SENSE COMPENSATION WITH SUITABLE PARAMETERS INTERNALLY TAILORED

FIELD OF THE INVENTION

This invention relates to a hearing aid and, more particularly, to a hearing aid for controlling hearing sense compensation with suitable parameters internally tailored.

DESCRIPTION OF THE RELATED ART

A provider usually regulates device characteristics of a conventional analog hearing aid to a user before delivery to the user. The regulation is called as "fitting". First, the provider measures the hearing sense of the user, and represents the measured hearing sense by an audiogram. Then, the provider fits the device characteristics to the audiogram, and delivers the analog hearing aid to the user.

A hearing aid digitally processes a signal representative of an input sound wave, and the digital signal processing unit is provided between an analog-to-digital converter and a digital-to-analog converter. Such a digitally signal processing hearing aid is called as "digitally programmable hearing aid", and the provider also fits the device characteristics of the digitally programmable hearing aid to the hearing sense of a user through the fitting work.

If a time variant filter is incorporated in the digital signal processing unit, the provider further gives parameters for defining the filtering characteristics to the digitally programmable hearing aid through the fitting work. The parameters for the time variant filter is hereinbelow referred to "hearing aid parameters".

Japanese Patent Publication of Unexamined Application No. 3-284000 discloses the digitally programmable hearing aid with the time variant filter. In this instance, the time variant filter is implemented by a frequency sampling structure type filter circuit, and the frequency sampling structure type filter circuit is responsive to an input signal for varying the filtering characteristics on the basis of the hearing aid characteristics given through the fitting work. However, the parameters given through the fitting work are so many and hardly imaged. For this reason, it is difficult for a user to carry out a fine control on the digitally programmable hearing aid.

Japanese Patent Publication of Unexamined Application No. 4-242400 discloses a volume controller for a hearing aid. The volume controller automatically regulates the volume to the fitting level of a user. However, if the user is getting more difficult in hearing, it is necessary to measure the hearing sense so as to fit the hearing aid to the user again.

Although the digitally programmable hearing aid disclosed in Japanese Patent Publication of Unexamined Application No. 3-284000 changes the filtering characteristics with the input signal level, the hearing aid parameters are unchanged, and the digitally programmable hearing aid can not cope with progression of hardness of hearing. The fitting work is required again.

The hearing aid equipped with the volume controller disclosed in Japanese Patent Publication of Unexamined Application No. 4-242400 automatically changes the volume. However, the loudness is merely one of the hearing characteristics, and other hearing characteristics relate to the hardness of hearing. Therefore, it is impossible to cope with the hardness of hearing, and the fitting work is required again.

SUMMARY OF THE INVENTION

It is therefore an important object of the present invention to provide a hearing aid the device characteristics of which is easily changeable.

To accomplish the object, the present invention proposes to internally produce suitable hearing aid parameters from sets of hearing aid parameters stored in a memory unit.

In accordance with the present invention, there is provided a hearing aid comprising: an acoustic signal-to-electric signal converting means for converting a first sound to a first electric signal; an electric signal-to-acoustic signal converting means for converting a second acoustic signal to a second sound; a signal modifying means connected between the acoustic signal-to-electric signal converting means and the electric signal-to-acoustic signal converting means, and responsive to a third electric signal representative of hearing aid parameters so as to modify the first electric signal to the second electric signal; a memory means including a plurality of memory sub-means for respectively storing a plurality of pieces of hearing aid data information in a readable manner; a working condition modifying means responsive to an instruction for working conditions for producing a fourth electric signal representative of a ratio of interpolation; and a parameter generating means responsive to the fourth electric signal so as to produce the third electric signal from pieces of hearing aid data information selected from the plurality of pieces of hearing aid data information through an interpolation at the ratio represented by the fourth electric signal.

BRIEF DESCRIPTION OF THE DRAWINGS

The features and advantages of the hearing aid according to the present invention will be more clearly understood from the following description taken in conjunction with the accompanying drawing in which FIGURE is a block diagram showing the arrangement of a hearing aid according to the present invention.

DESCRIPTION OF THE PREFERRED EMBODIMENT

Referring to the FIGURE, a hearing aid embodying the present invention is designated by reference numeral 1. The hearing aid comprises a microphone 2, an earphone 3, a digital signal processing unit 4, an analog-to-digital converter 5 connected between the microphone 2 and the digital signal processing unit 4, a digital-to-analog converter 6 connected between the digital signal processing unit 4 and the earphone 3, a memory unit 7 associated with the digital signal processing unit 4 and a manipulating board 8.

The microphone 2 picks up voice and/or sound, and generates an analog sound signal AS1 representative of the voice and/or sound. The analog sound signal AS1 is supplied to the analog-to-digital converter 5, and is converted to digital sound signal DS1 equivalent thereto. The digital sound signal DS1 is supplied to the digital signal processing unit 4, and the digital signal processing unit 4 processes the pieces of sound information represented by the digital sound signal. The digital signal processing unit 4 modifies attributes of the voice and/or sound as will be described hereinlater in detail, and generates a digital sound signal DS2 representative of the modified voice and/or sound. The digital sound signal DS2 is supplied to the digital-to-analog converter 6, and is converted to an analog sound signal equivalent thereto. The analog sound signal AS2 is supplied to the earphone 3, and the modified voice and/or sound is reproduced from the earphone 3.

The digital signal processing unit 4 includes a signal modifier 4*a*, an amplifier 4*b* and a controller 4*c*. A data signal DT1 represents suitable hearing characteristics or suitable hearing aid parameters, and is supplied to the controller 4*c*. When the data signal DT1 representative of the suitable hearing characteristics is supplied to the controller 4*c*, the controller 4*c* produces the hearing aid parameters from the suitable hearing characteristics, and forms a control signal CTL1 representative of the hearing aid parameters. On the other hand, when the data signal DT1 is representative of the suitable hearing aid parameters, the controller 4*c* directly forms the control signal CTL1 representative of the suitable hearing aid parameters.

The control signal CTL1 is supplied from the controller 4*c* to the signal modifier 4*a*, and the signal modifier 4*a* is responsive to the control signal CTL1 for processing the digital sound signal DS1. The signal modifier 4*a* supplies a digital sound signal DS3 to the amplifier 4*b*, and the amplifier 4*b* produces the digital sound signal DS2 from the digital sound signal DS3 through an amplification.

The digital signal processing unit 4 further includes an instructor 4*d*, an interpolator 4*e* and a controller 4*f*. The instructor 4*d* is connected to the manipulating board 8, and supplies instruction signals INS1 and INS2 to the interpolator 4*e* and the controller 4*f*, respectively. Various switches (not shown) are provided on the manipulating board 8. A user communicates with the instructor 4*d* through the switches, and informs the instructor 4*d* of user's requests.

One of the switches is assigned a selection of operation mode. The hearing aid 1 has a plurality of hearing aid modes for compensating the hearing sense of a user. The hearing aid 1 compensates the hearing sense at home through one of the hearing aid modes, on a street through another hearing aid mode and at night through yet another hearing aid mode. In order to compensate the hearing sense in different environments, the hearing aid stores a plurality of program sequences, and the voice and/or sound is differently processed by the digital signal processing unit 4 depending upon the selected mode. Another switch is used for changing working conditions such as, for example, user's hearing sense.

When the user requests the instructor 4*d* to change the operation mode, the instructor 4*d* supplies the instruction signal INS2 representative of the operation mode to be requested to the controller 4*f*. On the other hand, when the user changes the working conditions, the instructor 4*d* determines a ratio of interpolation, and supplies the instruction signal INS1 representative of the new ratio of interpolation to the interpolator 4*e*.

The memory unit 7 has a plurality of memory sub-units 70, 71, . . . and 7*n*, and the plurality of memory sub-units 70 to 7*n* respectively store a plurality of sets of hearing aid data representative of hearing aid characteristics or hearing aid parameters. The memory unit 7 further stores the control data defining the function of the hearing aid 7. The plurality of sets of hearing aid data and the control data are addressable, and are read out from the memory unit 7 to the interpolator 4*e*.

The interpolator 4*e* tailors suitable hearing aid parameters or suitable hearing aid characteristics from the hearing aid data stored in the memory unit 7. Namely, the interpolator 4*e* determines the suitable hearing aid characteristics or the suitable hearing aid parameters through an interpolation between the sets of hearing aid characteristics or the sets of hearing aid parameters at the ratio represented by the instruction signal INS1, and produces the data signal DT1 representative of the suitable hearing aid characteristics or the suitable hearing aid parameters.

The interpolator 4*e* is further operative to transfer the control data to the controller 4*f*. When the control data is read out from the memory unit 7 to the interpolator 4*e*, the interpolator 4*e* produces a data signal DT2 representative of the control data, and supplies the data signal DT2 to the controller 4*f*. The controller 4*f* supplies control signals CTL2 to CTLx to the signal modifier 4*a*, the controller 4*c*, the instructor 4*d*, the interpolator 4*e* and the memory unit 7.

The hearing aid 1 behaves as follows. Assuming now that a user wants to modify the working conditions, the user manipulates the switch, and the instructor 4*d* determines the ratio of interpolation on the basis of new working conditions. The instructor 4*d* further supplies the instruction signal INS2 representative of the change of working conditions, and the memory unit 7, the interpolator 4*e* and the controller 4*c* behave under the control of the controller 4*f* as follows.

Sets of hearing aid characteristics or sets of hearing aid parameters are read out from the selected memory sub-units to the interpolator 4*e*. The interpolator 4*e* produces suitable hearing aid characteristics or suitable hearing aid parameters from the sets of hearing aid characteristics or the sets of hearing aid parameters read out from the memory unit 7 through an interpolation at the ratio represented by the instruction signal INS1. The interpolator 4*e* supplies the data signal DT1 representative of the suitable hearing aid characteristics or the suitable hearing aid parameters to the controller 4*c*. If the data signal DT1 represents the suitable hearing aid characteristics, the controller 4*c* determines hearing aid parameters, and supplies the control signal CTL1 representative of the hearing aid parameters to the signal modifier 4*a*. On the other hand, if the data signal DT1 is representative of the suitable hearing aid parameters, the controller 4*c* produces the control signal CTL1 representative of the suitable hearing aid parameters, and supplies it to the signal modifier 4*a*.

Thus, a user easily modifies the device characteristics of the hearing aid 1 through the ratio of interpolation by changing the working conditions. The change of working conditions may be carried out as follows. Using a timer (not shown), the hearing aid 1 is linearly changed from a set of hearing aid characteristics to another set of hearing aid characteristics with time, and determines the amount of change in the day time. The amount of change is slightly given back in the night time. Using the present hearing aid characteristics, an extrapolation may be carried out so as to cope with a progression of hardness of hearing.

If the user does not change the working conditions, a set of hearing aid characteristics or a set of hearing aid parameters at the latest fitting is supplied to the controller 4*c* without an interpolation.

When the suitable hearing aid parameters are supplied to the signal modifier 4*a*, the hearing aid 1 appropriately compensates the hearing sense of the user. Sounds 1 is converted to the analog sound signal AS1, and the analog-to-digital converter 5 supplies the digital sound signal DS1 representative of the sounds SD1 to the signal modifier 4*a*. The suitable hearing aid parameters determines the circuit characteristics of the signal modifier 4*a*, and the digital sound signal DS1 is changed to the digital sound signal DS3 slightly different from the digital sound signal DS1. The amplifier 4*b* amplifies the digital sound signal DS3, and supplies the digital sound signal DS2 to the digital-to-analog converter 6. The digital-to-analog converter 6 converts the digital sound signal DS2 to the analog sound signal AS2, and the analog sound signal AS2 causes the earphone to reproduce sounds SD2 slightly modified from the sounds SD1.

In this instance, the acoustic signal-to-electric signal converting means and the electric signal-to-acoustic signal converting means are implemented by the microphone 2 and the earphone 3, respectively. The analog-to-digital converter 5, the signal modifier 4*a*, the amplifier 4*b* and the digital-to-analog converter 6 as a whole constitute the signal modifying means, and the manipulating board 8, the instructor 4*d*, the controller 4*f* form in combination the working condition modifying means. The controller 4*c* and the interpolator as a whole constitute the parameter generating means, respectively.

As will be appreciated from the foregoing description, the hearing aid according to the present invention tailors suitable hearing aid parameters on the basis of the plurality of pieces of hearing aid data information corresponding to the heading aid data, and a user easily carries out a fine control to the hearing aid.

Although a particular embodiment of the present invention has been shown and described, it will be obvious to those skilled in the art that various changes and modifications may be made without departing from the spirit and scope of the present invention.

For example, the hearing aid data may be supplied from a fitting system through an electric signal to a data port connected to the memory unit.

What is claimed is:

1. A hearing aid comprising:

an acoustic signal-to-electric signal converting means for converting a first sound to a first electric signal;

an electric signal-to-acoustic signal converting means for converting a second electric signal to a second sound;

a signal modifying means connected between said acoustic signal-to-electric signal converting means and said electric signal-to-acoustic signal converting means, and responsive to a third electric signal representative of hearing aid parameters so as to modify said first electric signal to said second electric signal;

a memory means including a plurality of memory sub-means for respectively storing a plurality of pieces of hearing aid data information in a readable manner;

a working condition modifying means responsive to an instruction for working conditions for producing a fourth electric signal representative of a ratio of interpolation; and a parameter generating means responsive to said fourth electric signal so as to produce said third electric signal from said plurality of pieces of hearing aid data information through an interpolation at said ratio represented by said fourth electric signal, wherein said working condition modifying means includes a switching means for generating a fifth electric signal representative of said working conditions, an instructor connected to said switching means for producing said fourth electric signal and a sixth electric signal representative of a user's request for modification, and a first controller connected to said instructor for receiving said sixth electric signal, wherein said memory means and said parameter generating means are configured to cause said parameter generating means to produce said third electric signal, wherein said parameter generating means includes an interpolator, supplied with said pieces of hearing aid information and responsive to said fourth electric signal for carrying out said interpolation, and a second controller connected to said interpolator for producing said third electric signal from the result of said interpolation, and wherein said ratio of interpolation is computed by said instructor based on receipt of said sixth electric signal which corresponds to the user's request for modification of said working conditions, the user's request for modification being inputted through said switching means.

2. The hearing aid as set forth in claim 1, wherein said plurality of pieces of hearing aid data information stored in said memory means includes sets of hearing aid parameters, sets of hearing aid characteristics, and control data, wherein said interpolar provides a seventh electric signal to said second controller that is representative of the control data read from said memory means, and wherein said interpolator provides one of an interpolated set of hearing aid parameters and an interpolated set of hearing aid characteristics to said first controller based on said fourth electric signal received from said instructor.

3. The hearing aid as set forth in claim 2, wherein said second controller provides control of said signal modifying means, said first controller, said instructor, said interpolator and said memory means based on the control data received from said interpolator.

4. The hearing aid as set forth in claim 3, wherein different sets of said hearing aid parameters and said sets of hearing aid characteristics are stored in different ones of said memory sub-means, and wherein said interpolar reads at least two of said sets of hearing aid parameters and said sets of hearing aid characteristics from different ones of said memory sub-means of said memory means, and performs an interpolation to output said one of said interpolated set of hearing aid parameters and said hearing aid characteristics to said first controller.

5. A hearing aid comprising:

an acoustic signal-to-electric signal converting means for converting a first sound to a first electric signal, and implemented by a microphone;

an electric signal-to-acoustic signal converting means for converting a second electric signal to a second sound, said electric signal-to-acoustic signal converting means including an earphone;

a signal modifying means connected between said acoustic signal-to-electric signal converting means and said electric signal-to-acoustic signal converting means, and responsive to a third electric signal representative of hearing aid parameters so as to modify said first electric signal to said second electric signal, said signal modifying means including an analog-to-digital converter connected to said microphone for converting said first electric signal from an analog form to a digital form, a signal modifier connected to said analog-to-digital converter and responsive to said third electric signal for modifying said first electric signal to said second electric signal compensating a hearing sense of a user, an amplifier connected to said signal modifier for amplifying said second electric signal and a digital-to-analog converter connected to said amplifier for converting said second electric signal from said digital form to said analog form;

a memory means including a plurality of memory sub-means for respectively storing a plurality of pieces of hearing aid data information in a readable manner;

a working condition modifying means responsive to an instruction for working conditions for producing a fourth electric signal representative of a ratio of interpolation; and a parameter generating means responsive to said fourth electric signal so as to produce said third electric signal from said plurality of pieces of hearing aid data information through an interpolation at said ratio represented by said fourth electric signal, wherein said working condition modifying means includes a switching means for generating a fifth electric signal representative of said working conditions, an instructor connected to said switching means for producing said fourth electric signal and a sixth electric signal representative of a user's request for modification, and a first controller connected to said instructor for receiving said sixth electric signal, wherein said memory means and said parameter generating means are configured to cause said parameter generating means to produce said third electric signal, wherein said parameter generating means includes an interpolator, supplied with said pieces of hearing aid data information and responsive to said fourth electric signal for carrying out said interpolation, and a second controller connected to said interpolator for producing said third electric signal from the result of said interpolation, and wherein said ratio of interpolation is computed by said instructor based on receipt of said sixth electric signal which corresponds to the user's request for modification of said working conditions, the user's request for modification being inputted through said switching means.

6. The hearing aid as set forth in claim 5, wherein said plurality of pieces of hearing aid data information stored in said memory means includes sets of hearing aid parameters, sets of hearing aid characteristics, and control data, wherein said interpolar provides a seventh electric signal to said second controller that is representative of the control data read from said memory means, and wherein said interpolator provides one of an interpolated set of hearing aid parameters and an interpolated set of hearing aid characteristics to said first controller based on said fourth electric signal received from said instructor.

7. The hearing aid as set forth in claim 6, wherein said second controller provides control of said signal modifying means, said first controller, said instructor, said interpolator and said memory means based on the control data received from said interpolator.

8. The hearing aid as set forth in claim 7, wherein different sets of said hearing aid parameters and said sets of hearing aid characteristics are stored in different ones of said memory sub-means, and wherein said interpolar reads at least two of said sets of hearing aid parameters and said sets of hearing aid characteristics from different ones of said memory sub-means of said memory means, and performs an interpolation to output said one of said interpolated set of hearing aid parameters and said hearing aid characteristics to said first controller.

9. A hearing aid comprising:

an acoustic signal-to-electric signal converter configured to convert a first sound to a first electric signal;

an electric signal-to-acoustic signal converter configured to convert a second electric signal to a second sound;

a signal modifying unit connected between said acoustic signal-to-electric signal converter and said electric signal-to-acoustic signal converter, and responsive to a third electric signal representative of hearing aid parameters so as to modify said first electric signal to said second electric signal;

a memory including a plurality of sub-memories for respectively storing a plurality of pieces of hearing aid data information in a readable manner;

a parameter generating unit responsive to a fourth electric signal so as to produce said third electric signal from said plurality of pieces of hearing aid data information through an interpolation at a ratio represented by said fourth electric signal; and a working condition modifying unit responsive to an instruction for working conditions and configured to produce said fourth electric signal representative of said ratio of interpolation, said working condition modifying unit including a switch for generating a fifth electric signal representative of said working conditions, an instructor connected to said switching means for producing said fourth electric signal and a sixth electric signal representative of a user's request for modification, and a first controller connected to at least said instructor, said memory and said parameter generating unit to cause said parameter generating unit to produce said third electric signal, wherein said parameter generating unit includes an interpolator supplied with said pieces of hearing aid information and responsive to said fourth electric signal for carrying out said interpolation and a second controller connected to said interpolator for producing said third electric signal from the result of said interpolation, and wherein said ratio of interpolation is computed by said instructor based on receipt of said sixth electric signal which corresponds to the user's request for modification of said working conditions, the user's request for modification being inputted through said switching means.

10. The hearing aid as set forth in claim 9, wherein said plurality of pieces of hearing aid data information stored in said memory means includes sets of hearing aid parameters, sets of hearing aid characteristics, and control data, wherein said interpolar provides a seventh electric signal to said second controller that is representative of the control data read from said memory means, and wherein said interpolator provides one of an interpolated set of hearing aid parameters and an interpolated set of hearing aid characteristics to said first controller based on said fourth electric signal received from said instructor.

11. The hearing aid as set forth in claim 10, wherein said second controller provides control of said signal modifying means, said first controller, said instructor, said interpolator and said memory means based on the control data received from said interpolator.

12. The hearing aid as set forth in claim 11, wherein different sets of said hearing aid parameters and said sets of hearing aid characteristics are stored in different ones of said memory sub-means, and wherein said interpolar reads at least two of said sets of hearing aid parameters and said sets of hearing aid characteristics from different ones of said memory sub-means of said memory means, and performs an interpolation to output said one of said interpolated set of hearing aid parameters and said hearing aid characteristics to said first controller.

* * * * *